US006978746B2

(12) United States Patent
Kibler

(10) Patent No.: US 6,978,746 B2
(45) Date of Patent: Dec. 27, 2005

(54) METHOD AND APPARATUS TO CONTROL A VARIABLE VALVE CONTROL DEVICE

(75) Inventor: Roland Glenn Kibler, Ann Arbor, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/379,947

(22) Filed: Mar. 5, 2003

(65) Prior Publication Data

US 2004/0173173 A1 Sep. 9, 2004

(51) Int. Cl.[7] ..... F01L 9/02
(52) U.S. Cl. ..... 123/90.12; 123/90.13; 123/90.16
(58) Field of Search ..... 123/90.15, 90.16, 123/90.17, 90.18, 90.12, 90.13

(56) References Cited

U.S. PATENT DOCUMENTS

| | | | | |
|---|---|---|---|---|
| 4,117,678 | A * | 10/1978 | Turner et al. | 60/369 |
| 4,606,313 | A * | 8/1986 | Izumi et al. | 123/386 |
| 4,807,552 | A * | 2/1989 | Fowler | 114/151 |
| 4,873,949 | A * | 10/1989 | Fujiyoshi et al. | 123/90.12 |
| 5,087,177 | A * | 2/1992 | Haley et al. | 417/426 |
| 5,447,026 | A * | 9/1995 | Stanley | 60/372 |
| 5,450,825 | A | 9/1995 | Geyer et al. | |
| 5,469,818 | A | 11/1995 | Yoshioka et al. | |
| 5,529,034 | A | 6/1996 | Sone et al. | |
| 5,570,621 | A | 11/1996 | Kabasin | |
| 5,657,725 | A | 8/1997 | Butterfield et al. | |
| 5,722,815 | A * | 3/1998 | Cozens | 417/310 |
| 5,937,806 | A * | 8/1999 | Lyko et al. | 123/90.15 |
| 6,173,684 | B1 * | 1/2001 | Buehrle et al. | 123/90.12 |
| 6,477,996 | B2 | 11/2002 | Ogawa | |
| 6,477,999 | B1 | 11/2002 | Markley | |
| 6,499,451 | B1 | 12/2002 | Hendriksma et al. | |
| 6,591,798 | B2 | 7/2003 | Hendriksma et al. | |
| 6,598,569 | B2 * | 7/2003 | Takemura et al. | 123/90.15 |
| 6,605,015 | B1 * | 8/2003 | Kinsley et al. | 475/86 |
| 6,659,200 | B1 * | 12/2003 | Eppink | 175/61 |
| 2002/0174843 | A1 | 11/2002 | Iwaki et al. | 123/90.17 |
| 2003/0168031 | A1 * | 9/2003 | Fenelon et al. | |

FOREIGN PATENT DOCUMENTS

| | | |
|---|---|---|
| DE | 19841734 | 3/1999 |
| DE | 10147336 | 5/2002 |

* cited by examiner

*Primary Examiner*—Thomas Denion
*Assistant Examiner*—Ching Chang
(74) *Attorney, Agent, or Firm*—Jimmy L. Funke

(57) ABSTRACT

The present invention provides an improvement over conventional engine control systems for variable valve control devices for the valvetrain in that it provides a substantially closed-circuit hydrostatic fluid control system and accompanying method to improve response time of the variable valve control device and reduce energy consumption by an engine oil pump. The hydrostatic fluid control system preferably comprises a bi-directional fluid-pumping device that is fluidly connected to a variable valve control device. A controller is operable to control the bi-directional fluid-pumping device and operable to determine rotational position of the variable valve control device.

1 Claim, 4 Drawing Sheets

METHOD AND APPARATUS TO CONTROL A VARIABLE VALVE CONTROL DEVICE

TECHNICAL FIELD

This invention pertains generally to internal combustion engine control systems, and more specifically to a method and apparatus to operate a variable valve control device using a hydrostatic fluid control system.

BACKGROUND OF THE INVENTION

Engine manufacturers incorporate valve train systems with variable valve control systems to improve operating and emissions performance of internal combustion engines. These variable valve control systems include systems to accomplish variable cam phasing, cylinder deactivation, and variable valve lift and duration. Distinct engine operating characteristics resulting from use of the variable valve system include improved combustion stability at idle, improved airflow through the engine over a range of engine operations corresponding to improvements in engine performance, and improved dilution tolerance in a combustion charge. Benefits of incorporating the variable valve system into an engine include improved fuel economy, improved torque at low engine speeds, lower engine cost and improved quality through elimination of external exhaust gas recirculation ('EGR') systems, and improved control of engine exhaust emissions.

A typical internal combustion engine is comprised of at least one cylinder containing a piston that is attached to a rotating crankshaft by a piston rod. The piston slides up and down the cylinder in response to combustion events that occur in a combustion chamber formed in the cylinder between the piston and a head. The head contains one or more intake valves to control the flow of air and fuel into the combustion chamber, and one or more exhaust valves that control the flow of exhaust gases out of the combustion chamber. A rotating camshaft opens and closes the intake and exhaust valves, and is synchronized with the position of each piston and the crankshaft. As an example of a variable valve system, a typical variable cam phasing system includes a variable cam phaser attached to an engine camshaft, and a cam position sensor that measures rotational position of the camshaft. The variable cam phasing system varies the opening and closing of each affected valve by varying angular position and rotation of the camshaft, relative to angular position and rotation of the crankshaft and each respective cylinder. An oil control valve diverts flow of pressurized engine oil to control the variable cam phaser, primarily based upon feedback from the cam position sensor. Typically an electronic engine controller controls this operation.

Timing, duration, and amplitude of valve opening affects mass of air that flows into an individual cylinder, thus affecting volumetric efficiency of the internal combustion engine. Fuel delivery to the internal combustion engine is typically determined by measuring or calculating mass air flow and determining an air/fuel ratio required to meet operator demand for performance and requirements for engine emissions. A quantity of fuel for delivery to each cylinder is determined based upon the combination of mass airflow and the required air/fuel ratio. A combustion charge is then created in each cylinder by delivering the quantity of fuel near the intake valve of the cylinder, or directly into the cylinder. This is known to one skilled in the art.

Performance of the variable valve control system, in terms of response time and ability to maintain the valve opening relative to piston position, may be affected by several system factors. These system factors include, for example, oil contamination, wear and viscosity, part-to-part variability caused by manufacturing tolerances, engine operating temperature, and component wear. These factors result in an inability of the controller to precisely control the variable valve control system, including a reduction in the range of motion of the valve. Any benefits derived from the variable valve control system can be compromised as a result.

By way of example, the engine controller uses the variable cam phasing system on air intake valves to open each valve early in the intake stroke to improve airflow into the cylinder and increase volumetric efficiency at low engine speeds. The result is improved engine torque at low speeds, allowing for improved vehicle acceleration. In typical current variable cam phasing systems, the system is calibrated based upon a known set of operating factors and a limited quantity of components. The controller is able to compensate for many of the effects caused by the system factors previously discussed (i.e. contamination, part-to-part variability, engine operating temperature, oil viscosity, and component wear) with feedback from the cam position sensor and exhaust gas sensors.

Pressurized oil required for operation of the variable valve control device is typically supplied from an engine oil system, using an oil control valve to divert oil flow. The engine oil system employs an oil pump powered by the engine. A typical system requires the engine oil system to provide a sufficient quantity of pressurized oil at 1.5 bar to effectively move the variable valve control device and achieve desired performance benefits. The oil pressure and flow to the variable valve control device is dependent upon variation in engine operating factors including speed and load, and the system factors mentioned previously. Response time and ability of the control valve to control the variable valve control system is dependent upon pressure and flow of oil through the oil control valve.

An engine designer specifies engine oil pump pumping capacity, in terms of flow and pressure, to ensure adequate pump performance to meet engine requirements, plus additional flow and pressure to operate the variable valve control device over the life of the engine. Operation of the variable valve control device includes an ability to move the device to a commanded position, and an ability to maintain the device at the commanded position. Moving the variable valve control device to the commanded position typically comprises a greater amount of flow than maintaining the variable valve control device at the commanded position. The controller uses the oil control valve to limit oil flow to the variable valve control device after it has been moved to the commanded position, and any remaining oil flow is diverted to other engine systems. Determination of the pumping capacity also includes compensation for effect of system factors, including oil contamination, wear and viscosity, part-to-part variability caused by manufacturing tolerances, engine operating temperature, and component wear. It is apparent that a portion of oil pumping capacity is unused over much of the life of the engine. This extra capacity adds unnecessary cost to the pump and consumes energy during operation.

Benefits of adding a variable valve control device must be balanced against increased system complexity and added cost to the base engine necessary to effectively operate the variable valve control device over the life of the engine. In cases wherein compromises are made in design of a system, benefits resulting from the system will not accrue, or will be offset by added cost to components of the system. Hence, there is a need for a method and system to effectively control a variable valve control system, while minimizing system complexity and added cost, and minimizing amount of energy consumed by the system.

SUMMARY OF THE INVENTION

The present invention provides an improvement over conventional engine control systems with variable valve timing devices for the valvetrain in that it provides a closed-circuit hydrostatic fluid control system to improve response time of the variable valve timing device and reduce energy consumption by the oil pump. The hydrostatic fluid control system preferably comprises a bi-directional fluid-pumping device that is fluidly connected to the variable valve control device. A controller is operable to control the bi-directional fluid-pumping device and operable to determine rotational position of the variable valve control device. Hence, the controller controls the bi-directional fluid pumping device based upon the rotational position of the variable valve control device, relative to crankshaft position. The bi-directional fluid-pumping device comprises a substantially positive-displacement pump element that is operably attached to an electric motor electrically operably connected to the controller. The variable valve control device comprises a variable cam phaser operably attached to a camshaft. In the alternative, the variable valve control device can comprise a variable valve timing device, or a variable valve lift and duration device. The invention also includes a fluid pumping device that has unidirectional flow, and employs flow switching valves to accomplish change in flow direction to the variable valve timing device.

The present invention also comprises a method of controlling a hydrostatic fluid control system for a variable valve control device that is operably attached to a camshaft of an internal combustion engine, comprising determining rotational position of the camshaft, and controlling the bi-directional fluid-pumping device fluidly operably attached to the variable valve control device, based upon the rotational position of the camshaft. These and other aspects of the invention will become apparent to those skilled in the art upon reading and understanding the following detailed description of the embodiments.

BRIEF DESCRIPTION OF THE DRAWINGS

The invention may take physical form in certain parts and arrangement of parts, the preferred embodiment of which will be described in detail and illustrated in the accompanying drawings which form a part hereof, and wherein.

DETAILED DESCRIPTION OF THE PREFERRED EMBODIMENT

Figure 1:
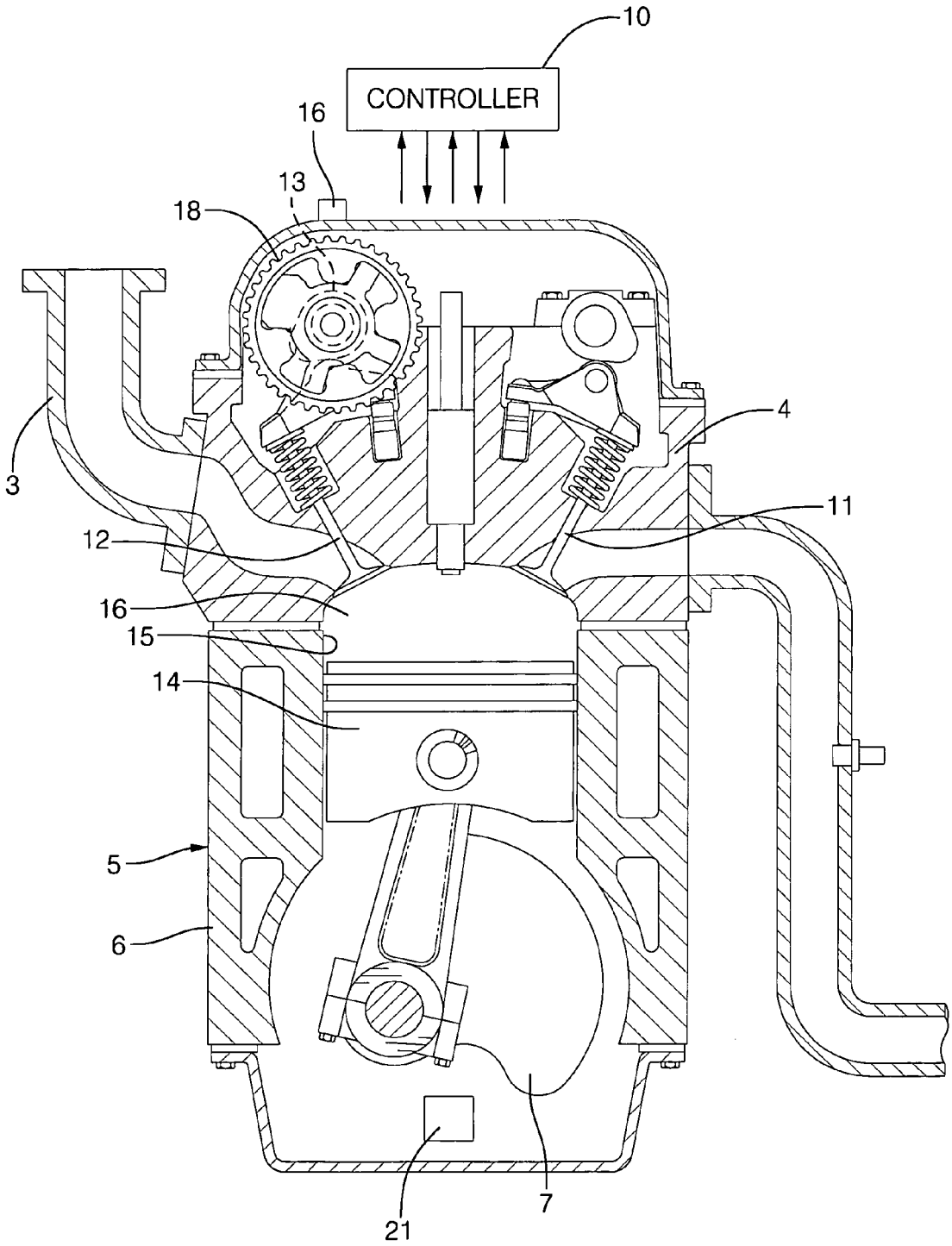
FIG. 1 is a schematic diagram in accordance with the present invention.

Referring now to the drawings, wherein the showings are for the purpose of illustrating an embodiment of the invention only and not for the purpose of limiting the same, FIG. 1 shows an internal combustion engine 5, controller 10 and substantially closed-circuit hydrostatic fluid control system for controlling a variable valve control device 18 which has been constructed in accordance with an embodiment of the present invention. In this embodiment, the variable valve control device 18 comprises a variable cam phaser 18 operably attached to an intake camshaft 13. The substantially closed-circuit hydrostatic fluid control system comprises a bi-directional fluid-pumping device (See FIG. 2, item 20) fluidly connected to the variable cam phaser 18. The controller 10 is operable to control the bi-directional fluid-pumping device 20 and to determine a position of the variable cam phaser 18, using a cam position sensor (See FIG. 2, item 16). The controller 10 controls the bi-directional fluid pumping device 20, based upon the determined position of the variable cam phaser 18.

Referring again to FIG. 1, the exemplary internal combustion engine 5 is shown, comprising an engine block 6 with a single bank of in-line cylinders 15 and a head 4. There is a piston 14 in each cylinder that is operably attached to a crankshaft 7 by a piston rod. The crankshaft 7 is mounted at a base of the engine block 6. Each piston is operable to slide up and down each cylinder during engine operation, thus causing the crankshaft to rotate. The head 4 preferably includes air passages that permit airflow from an intake manifold 3 to each cylinder 15, and separate air passages that permit airflow out of each cylinder into an exhaust manifold 9. A valvetrain is typically assembled into the head 4 to manage flow into and out of each cylinder. The valvetrain comprises at least one intake valve 12 per cylinder to manage flow into each cylinder, and at least one exhaust valve 11 per cylinder to manage flow out of each cylinder. In this embodiment there is an intake camshaft 13 to individually actuate and control opening and closing of each intake valve 12, and a separate camshaft (not shown) to individually actuate and control opening and closing of each exhaust valve 11. The variable cam phaser 18 is operably attached to the intake camshaft 13, and hence able to control the opening and corresponding closing of each intake valve 12. The variable cam phaser 18 is operably attached to the crankshaft 7 of the engine typically via a belt drive (not shown), such that rotation of the variable cam phaser 18 and the camshaft 13 is synchronized to rotation of the crankshaft 7. The intake camshaft 13 rotates around an axis and is operable to open and close each intake valve 12 corresponding to each cylinder 15 of the engine 5. The intake camshaft 13 opens each intake valve 12 relative to a top-dead center point of each piston 14 in the corresponding cylinder 15. The cam position sensor 16 is operable to determine rotational position of the camshaft 13, and the crank sensor 21 is operable to measure rotational position of the crankshaft 7. The controller 10 preferably uses the cam position sensor 16 to measure an opening of each intake valve 12 in units of degrees of camshaft rotation before the top-dead center point. The opening of each intake valve 12 is also determined relative to rotational position of the crankshaft 7. The engine with engine block, head, pistons, camshaft, crankshaft and controller are well known to one skilled in the art.

The controller 10 is preferably operably attached to other sensors and output devices to monitor and control engine operation. The output devices preferably include subsystems necessary for proper control and operation of the engine 5, including a fuel injection system, a spark-ignition system, an electronic throttle control system, and an evaporative control system (not shown). The sensors include devices operable to monitor engine operation, external conditions, and operator demand, and are electrically attached to the controller 10. The engine sensors preferably comprise the cam position sensor 16, an exhaust gas sensor, the crank sensor 21 to measure engine speed and crank position, a manifold absolute pressure sensor to determine engine load, a throttle position sensor, a mass air flow sensor, and others (not shown). Other sensors preferably include an accelerator pedal position sensor, among others (not shown). The controller 10 controls operation of the engine 5 by collecting input from the sensors and controlling the output devices, using control algorithms and calibrations internal to the controller 10 and the various sensors. The use of a controller to control the operation of an internal combustion engine using output devices based upon input from various sensors is well known to those skilled in the art.

Figure 2:
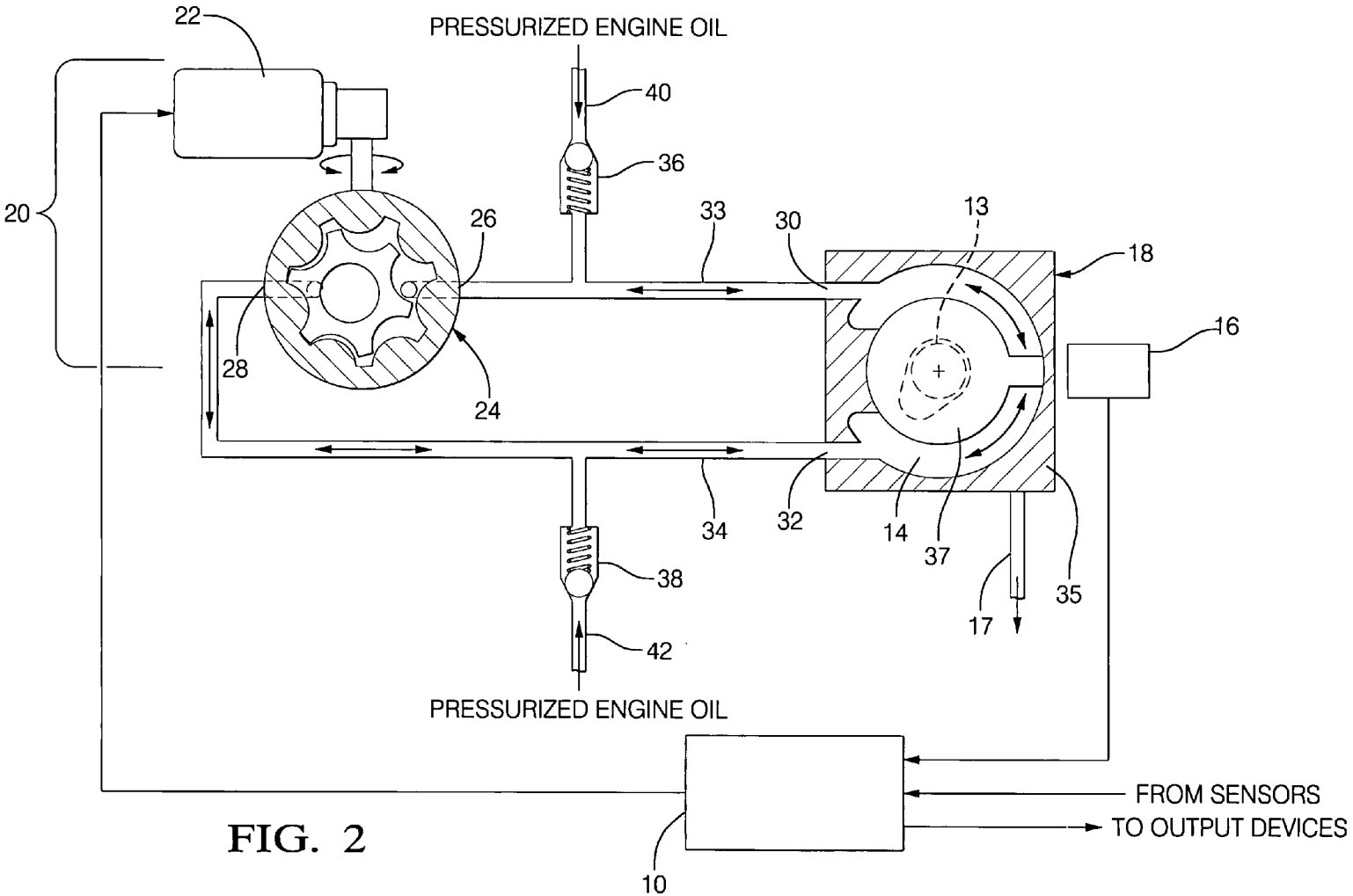
FIG. 2 is a schematic diagram, in accordance with the present invention.

Referring now to FIG. 2, a schematic diagram of the invention is shown, detailing the elements of the substantially closed-circuit hydrostatic fluid control system. The bi-directional fluid-pumping device 20 fluidly connected to the variable valve control device 18 preferably comprises a substantially positive-displacement pump element 24 operably attached to an electric motor 22 that is electrically operably connected to the controller 10. The pump element 24 is preferably a substantially positive displacement pump element capable of bi-directional flow. In this embodiment, the pump element 24 comprises a gerotor pump. Typical and maximum flow capability of the pump 20 must be matched to meet flow requirements of the variable valve control device 18. In this embodiment, the pump element 24 with a maximum flow capacity of at least 4.5 liters per minute is required to meet needs of the variable cam phaser 18. The motor 22 is preferably a bi-directional rotating electric motor capable of operating in clockwise and counterclockwise directions, depending upon polarity of an input signal from the electronic controller 10. Input to the motor 22 from the controller 10 preferably comprises a pulsewidth-modulated electrical input signal, wherein direction and volumetric flow from the pump element 24 is based upon duty cycle and polarity of the input to the motor 22. Positive displacement pump elements, including gerotor pump elements, accompanying electric motors, and input control signals from a controller are known to one skilled in the art.

The hydrostatic fluid control system is preferably a closed-circuit fluid system wherein the fluid remains substantially contained within the hydrostatic fluid control system. The bi-directional fluid-pumping device 20 is preferably mounted adjacent the variable cam phaser 18. The fluid-pumping device 20 has a first output 26 that is fluidly attached to a first fluid input 30 of the variable cam phaser 18 by way of a first passageway 33. There is a second output 28 of the fluid-pumping device 20 that is fluidly attached to a second fluid input 32 of the variable cam phaser 18 by a way of a second passageway 34. Fluid, in this case engine oil, is input to the hydrostatic fluid control system via two unidirectional flow conduits 40, 42 that fluidly connect an engine oil pump (not shown) to the first and second passageways 33, 34, and is pressurized at a pressure level of the oil pump. The unidirectional flow conduits 40, 42 each include at least one check valve 36, 38 that permit the flow from the engine oil pump to the passageways 33, 34, while preventing backflow to the engine oil pump. Any fluid leakage that occurs through the system, e.g. through the variable cam phaser 18, is supplemented by flow of oil from the engine oil pump (not shown) into the system through one of the unidirectional flow conduits 40, 42. Leakage in the system may flow out of the variable cam phaser 18 through a drain line 17 to an engine sump (not shown). Each of the check valves 36, 38 preferably include a design feature wherein opening response of each valve is delayed when pressure in the first or second passageway 33, 34 drops below pressure in the flow conduits 40, 42 from the engine oil pump (not shown). Implementation of the design feature of delayed opening response of each check valve 36, 38 increases the pressure drop across the variable cam phaser 18, and improves responsiveness of the variable cam phaser 18. Design of flow conduits and check valves is known to one skilled in the art.

The invention also comprises a method of controlling the hydrostatic fluid control system for the variable valve control device operably attached to the internal combustion engine. This includes implementing the substantially closed-circuit fluid control system described hereinabove, including the fluid pumping device 20 fluidly operably connected to the variable valve control device 18 operably attached to the valvetrain. In this embodiment, the variable valve control device 18 is the variable cam phaser 18, which is operably attached to the intake camshaft 13. The method includes determining rotational position of the camshaft 13, and controlling the fluid-pumping device 20 that is fluidly operably connected to the variable cam phaser 18, based upon the determined rotational position of the camshaft 13. Controlling flow of fluid from the fluid-pumping device 20 fluidly operably connected to the variable valve control device comprises regulating direction and volumetric flow of fluid using the fluid-pumping device 20. Controlling rotational position of the camshaft 13 includes controlling rotational position of the camshaft 13 relative to position of the crankshaft 7 of the internal combustion engine 5.

Referring again to the embodiment with the variable cam phaser 18, the controller 10 determines an operating position for the camshaft 13 based upon engine operating characteristics and operator demand. In an example of operation, the controller 10 advances intake valve 12 opening time relative to piston 14 position and crankshaft 7 position, during a low speed, open throttle operation to increase volumetric efficiency and low-end engine torque and acceleration. The controller 10 controls direction and magnitude of rotation of the electric motor 22 to control direction and magnitude of fluid flow from the substantially positive-displacement pump element 24 through the passageways 33, 34 to the variable cam phasing device 18. In so doing, the controller 10 advances opening of the intake valve 12, thus optimizing engine performance. Selection of an optimal operating position for the camshaft 13 based upon the engine operating characteristics and operator demand is dependent upon engine size, engine design factors and specific operating point of the engine. Optimal operating position of the camshaft is typically determined during engine calibration. This is known to one skilled in the art.

Figure 3:
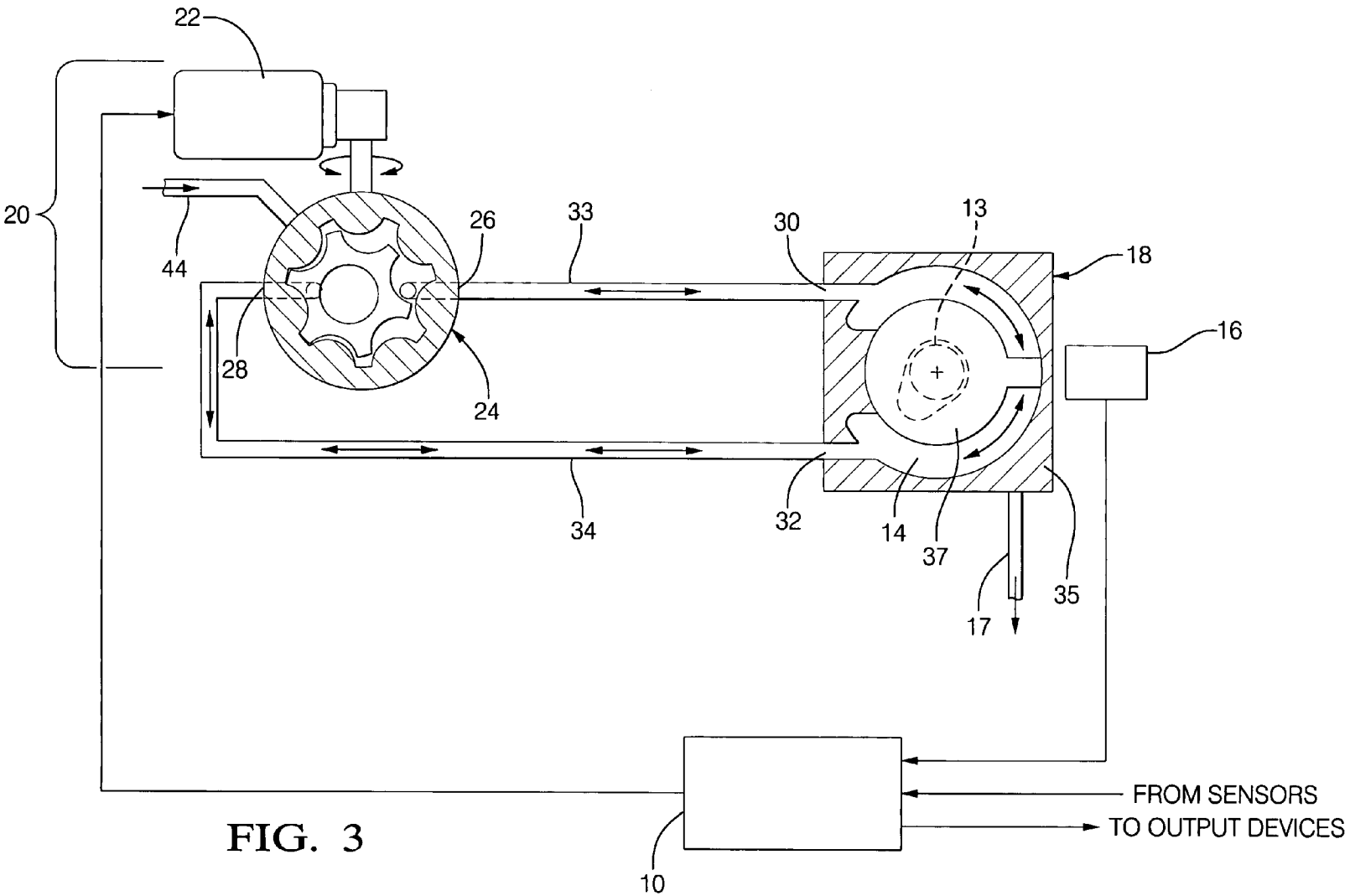
FIG. 3 is a schematic diagram, in accordance with the present invention; and, FIG. 4 is a schematic diagram, in accordance with the present invention.

Referring now to FIG. 3, an alternate embodiment of the hydrostatic fluid control system is shown, designed to operate at fluid pressures significantly higher than 1.5 bar. This embodiment enables redesign and optimization of the variable valve control device, and includes features of reduced package size for improved fit into the engine, and reduced oil leakage. The embodiment allows for design optimization of the engine oil pump (not shown), without an added requirement of sufficient flow and pressure to operate the variable valve control device 18. The unidirectional flow conduits and check valves of the original embodiment described hereinabove have been removed. In this embodiment, the bi-directional fluid pumping device preferably comprises a multi-stage bi-directional pumping device (24, not shown in detail) and allows replacement oil to be supplied to the hydrostatic system through the bi-directional fluid pumping device through a pressurized inlet 44 from the engine oil pump (not shown) into the multi-stage pumping device.

Figure 4:
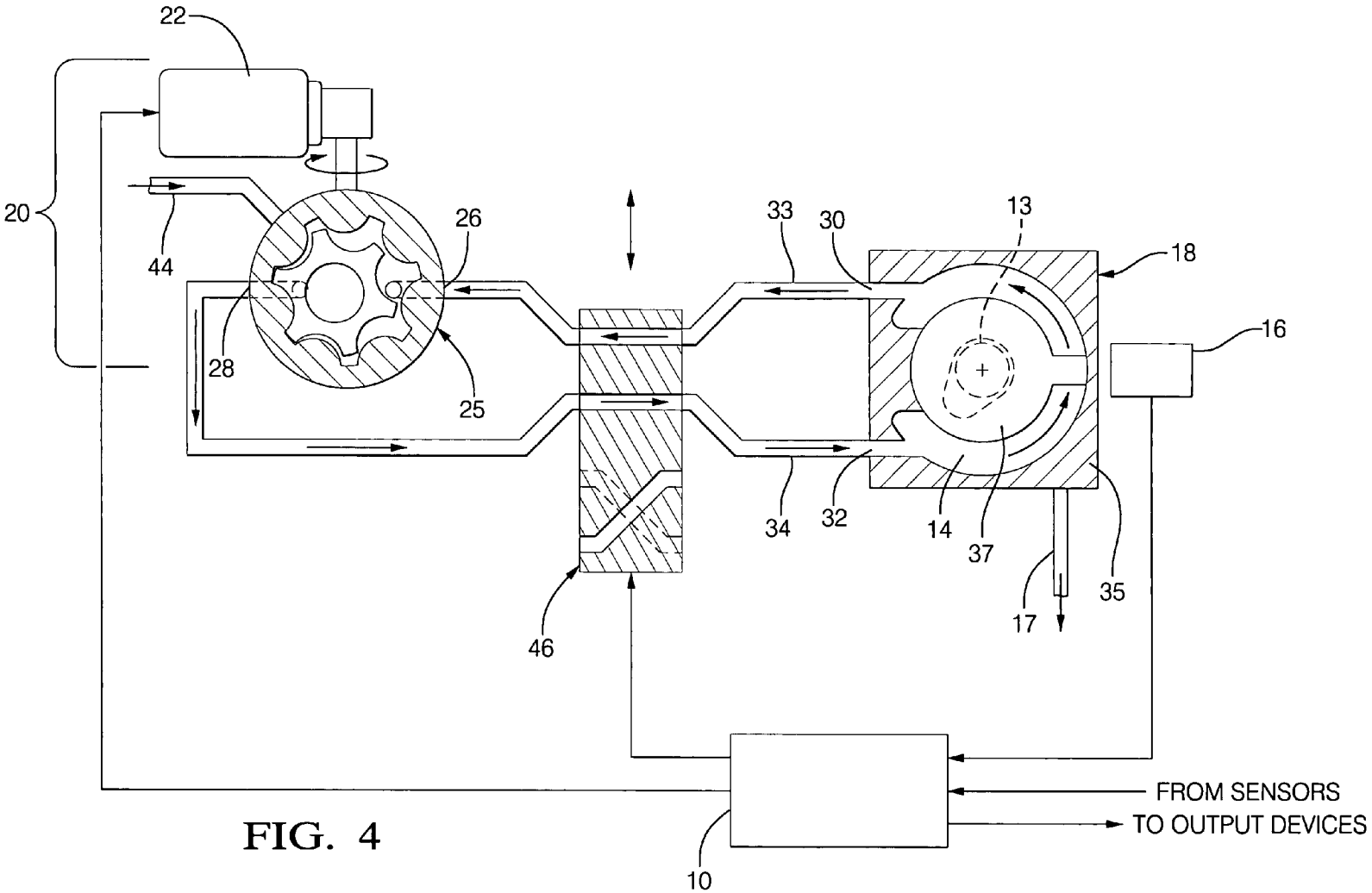

Referring now to FIG. 4, an alternate embodiment of the hydrostatic fluid control system is shown wherein the hydrostatic fluid control system with the fluid pumping device comprises the pump 20 including a unidirectional fluid-pumping element 25 with an in-line flow valve 46 controlled by the controller 10. The unidirectional fluid-pumping element 25 is preferably a multi-stage pumping element, as described previously in reference to FIG. 3. In this embodiment, the controller 10 controls direction of flow to the variable valve control device by selecting a position of the in-line flow switching valve 46 and corresponding flow path. The first fluid output and the second fluid output of the fluid-pumping device are operably fluidly connected to the variable valve control device using a flow switching valve. When the flow switching valve 46 is in a first position, the first fluid output 26 is fluidly connected to the first fluid input of the variable valve control device 18 and the second fluid output 28 is fluidly connected to the second fluid input 32 of the variable valve control device 18. When the flow switching valve 46 is in a second position, the first fluid output 26 is fluidly connected to the second fluid input 32 of the variable valve control device 18 and the second fluid output 28 is fluidly connected to the first fluid input 30 of the variable valve control device 18. Flow switching valves are known to one skilled in the art.

Although this is described as a hydrostatic fluid control system for a variable valve control system of an intake valve system in an internal combustion engine, it is understood that there are alternate embodiments of this invention. The variable valve control system can also comprise a control system for valvetrain controlling exhaust valves 11 in the head 4 of the engine 5, or a control system for a variable valve lift and duration system, a variable valve timing system, or a cylinder deactivation system. The system preferably employs a primarily positive displacement pump element 24, which can be any one of a number of positive displacement pump elements. The system can instead employ an alternative pumping element, other than a primarily positive displacement pump, that is able ability to meet the flow, pressure, and response time requirements of the hydrostatic fluid control system. In addition, the substantially positive-displacement pump element 24 can instead comprise a multistage fluid pumping element, enabling the pump element to provide supplemental fluid to the hydrostatic fluid control system, as described previously in reference to FIG. 3.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. A hydrostatic fluid control system for controlling a valvetrain of an internal combustion engine, comprising:

a substantially closed-circuit fluid control system including a fluid pumping device fluidly operably connected to a variable valve control device operably attached to the valvetrain;

wherein the substantially closed-circuit fluid control system comprises the fluid-pumping device having a first fluid output fluidly connected to a first fluid input of the variable valve control device by way of a first passageway, and a second fluid output fluidly connected to a second fluid input of the variable valve control device by way of a second passageway;

the fluid pumping device comprising a unidirectional fluid pumping device with fluid input; and, the first fluid output and the second fluid output operably fluidly connected to the variable valve control device using a flow switching valve, wherein:

when the flow switching valve is in a first position, the first fluid output is fluidly connected to the first fluid input of the variable valve control device and the second fluid output is fluidly connected to the second fluid input of the variable valve control device; and, when the flow switching valve is in a second position, the first fluid output is fluidly connected to the second fluid input of the variable valve control device and the second fluid output is fluidly connected to the first fluid input of the variable valve control device;

wherein the fluid pumping device operates based upon a rotational position of the valvetrain.

* * * * *